United States Patent [19]

Hargest, III

[11] Patent Number: 4,556,123

[45] Date of Patent: Dec. 3, 1985

[54] PATIENT EVACUATION SYSTEM FROM A MULTISTORY STRUCTURE

[76] Inventor: Thomas S. Hargest, III, 330 Concord St., Charleston, S.C. 29401

[21] Appl. No.: 628,025

[22] Filed: Jul. 5, 1984

[51] Int. Cl.[4] ..... A62B 1/20

[52] U.S. Cl. ..... 182/36; 182/10; 182/82; 182/150; 182/193; 187/12

[58] Field of Search ..... 182/10, 11, 12, 13, 182/36, 37, 82, 193, 150; 187/12, 13, 14, 7

[56] References Cited

U.S. PATENT DOCUMENTS

| | | | |
|---|---|---|---|
| 171,167 | 12/1875 | Potter | 187/12 |
| 276,815 | 5/1883 | Heidel | 182/36 |
| 293,451 | 2/1884 | Grosscup | 182/36 |
| 952,239 | 3/1910 | Davidson . | |
| 1,282,323 | 10/1918 | Trinkle | 182/10 |
| 1,470,388 | 10/1923 | Pitou | 182/37 |
| 1,823,385 | 9/1931 | Barker | 182/150 |
| 1,950,996 | 3/1934 | Potter | 182/48 |
| 2,070,334 | 2/1937 | Garber | 182/150 |
| 2,589,803 | 3/1952 | Haley | 182/36 |
| 2,863,594 | 12/1958 | Shafer | 182/36 |
| 3,121,476 | 2/1964 | Mazarelli | 187/12 |
| 3,513,940 | 5/1970 | Ussery | 182/187 |
| 3,831,711 | 8/1974 | Smith | 182/40 |
| 3,915,258 | 10/1975 | Nusslein | 182/48 |
| 3,944,021 | 3/1976 | Smith | 182/3 |
| 4,049,080 | 9/1977 | Suzuki | 182/48 |
| 4,079,812 | 3/1978 | Naka | 182/48 |
| 4,122,917 | 10/1978 | Kendrick | 182/144 |
| 4,125,172 | 11/1978 | Hatala | 182/36 |
| 4,207,965 | 6/1980 | Cheng | 182/36 |
| 4,262,772 | 4/1981 | Richardson | 182/48 |
| 4,267,900 | 5/1981 | Lung | 182/36 |

*Primary Examiner*—Reinaldo P. Machado
*Attorney, Agent, or Firm*—Dority & Manning

[57] ABSTRACT

An evacuation system for nonambulatory patients from a multistory hospital or the like. A trackway is secureable to a wall of a stairwell and includes a hanger rail support. A hanger is rotatably associable with the hanger rail support and has elongated elements suspended from same for securement to a wheelchair, stretcher, or the like. A brake system is associated with the hanger to normally brake rollers, wheels, or the like of same against movement. A brake release apparatus is operatively associated with the brake system from the hanger for actuation by a patient or attendant to permit the hanger to carry the patient along the trackway.

26 Claims, 6 Drawing Figures

PATIENT EVACUATION SYSTEM FROM A MULTISTORY STRUCTURE

BACKGROUND OF THE INVENTION

The present invention relates to an evacuation system for the removal of bedridden patients from multistory hospitals, nursing homes, and the like, which system is efficient and easily manipulatable by the patient, or an attendant.

Much concern has been expressed over the patent inability to evacuate bedridden patients from multistory hospitals, nursing homes, and the like in the event of a catastrophe such as fire, earthquake, or other natural or accidental occurance which would dictate evacuation. During the occurance of any such disaster, particularly, fire, there is a likelihood that a loss of power will exist throughout the disaster, thereby rendering elevators unavailable for use for evacuation. In fact cessation of use of elevators is recommended in the event of fire from any multistory structure due to the hazzards accompanying same. While ambulatory patients may walk down the stairs from a number of stories without any significant problems, it has been shown through trials that two healthy attendants carrying a one hundred and fifty pound patient require assistance after three floors. Moreover, while the attendant fatigue factor is quite paramount, also there are generally not enough staff and/or attendants on duty at any one time to successfully evacuate a multistory hospital, nursing home or the like if more than one attendant is required for evacuation of every patient. Still further, with a conventional stretcher exceeding seven feet in length, difficulty can be encountered in negotiating the curves at landings between flights of stairs.

Prior systems have been devised for enabling inhabitant evacuation from multistory structures generally. Such devices, however, are not primarily intended for, or suitable for, hospital or nursing home use where nonambulatory patients need to be evacuated. Many of the prior devices include assemblies that permit an individual to climb inside a chute and to slide down the chute to ground level. Such of course would be totally unsuitable for hospital use. Other systems have included structures exterior to the building which follow a zig zag path down an outside wall of the building or down a further structure secured to an outside wall of the building. In such exterior systems, cars of some description may be associated with a zig zag track to follow same during the descent from upper stories. Again, such structures are totally unsuitable for hospital use where attendants will be necessary for many, if not the majority, of the patients to be evacuated. Specifically, while the evacuation cars of the prior art are suitable for descent down a vertical zig zag trackway, and are generally equipped with a braking device, the angle of descent and the size of the cars prohibits use of stretchers or some other type patient carrying element for receipt of a patient in a suppine or generally suppine position. Also, many patients being evacuated would be incapable of manipulating a hand brake to slow the descent of the car along the vertical zig zag track.

The known prior art structures also often require construction of a suitable housing for the system. Should a housing be necessary, as mentioned above, same would be added to the exterior of the multistory structure.

The present invention overcomes the problems specified above and others with respect to prior art systems, in an environment for evacuating nonambulatory patients from a multistory hospital or the like. Not only is the present system quite efficient in use, and capable of permitting gradual, controlled descent of a patient a sitting or suppine position with attendants to assist the patient in descent, if necessary, the system may be retrofitted into any existing multistory structure in which a stairwell is provided throughout the height of the building. Furthermore, while the present system is securable within an existing stairwell, it is very important to point out that when not in use for evacuation, normal use of the stairwell is not impaired in any way. Last but not least, the simplicity of the present system coupled with a lack of need for a power supply, lends itself to practical and economical utilization.

There is no known prior art that would teach or suggest the patient evacuation system of the present invention. Exemplary of known prior art which is broadly discussed above includes: U.S. Pat. Nos. 952,239 to Davidson; 1,950,996 to Potter; 3,831,711 to Smith; 3,915,258 to Nusslein; 3,944,021 to Smith, Jr., et al; 4,049,080 to Suzuki; 4,079,812 to Naka; 4,122,917 to Kendricki; 4,125,172 to Hatala; 4,207,965 to Chiang-Cheng et al; 4,262,772 to Richardson; 4,267,900 to Yin-Lung.

SUMMARY OF THE INVENTION

It is an object of the present invention to provide an improved patient evacuation system for use in multistory hospitals, nursing homes and the like.

Another object of the present invention is to provide an improved evacuation system for persons from a multistory structure through an existing stairwell in the structure.

Yet another object of the present invention is to provide an improved patient evacuation system for use in a multistory structure which system may be retrofitted into an existing stairwell.

Still further another object of the present invention is to provide a patient evacuation system for use in multistory hospitals, nursing homes and the like, on which nonambulatory patients may be evacuated with a minimum of assistance and without excessive fatigue of attendants accompanying the patients.

Generally speaking, the patient evacuation system according to the present invention comprises a trackway means mountable in a stairwell at a height that normal use of stairs located in the stairwell will not be impaired thereby when the system is not in use, said trackway means including a hanger rail support means and mounting means secured thereto, said mounting means being adaptable for securement within said stairwell above said stairs; hanger means associable with said trackway, said hanger means having roller means received thereon for rotatable receipt on said hanger rail support while being precluded against significant lateral movement with respect thereto; said roller means having brake means associated thereto, means associable with said hanger means for securement to a patient carrying element; and brake release means associated with said hanger means, said brake release means having brake release actuator means associated therewith and being accessible to said patient carrying element to be suspended from said hanger means.

More specifically, the evacuation system of the present invention preferably includes a pair of spaced apart rails that extend along a stairwell from an upper floor to the ground floor with appropriate curved segments being located therealong at landings between flights of stairs. The spaced apart rails are secured to a side wall or a ceiling of the stairwell, hereinafter jointly referred to as wall, such that the rails are maintained over the stairs, at a height adequate to preclude any interferrence with normal use of the stairs. The two rail system is preferably united at spaced apart locations along the length of same by shrouds secured thereto and extending upwardly over same. Support elements are secured to the shrouds at one end and to a mounting bracket at an opposite end with the mounting bracket being secured to the stairway wall. Furthermore, the rails are each preferably provided with means thereon to preclude any significant lateral movement of a hanger means associated therewith during descent, whereby once the hanger means is received on the rails, it will remain thereon until removed.

Individual hanger means are provided with the evacuation system with one or two hanger means being utilized to evacuate a single patient, depending upon the arrangement of same. Particularly, a preferred hanger body is elongated in nature with a crossing support bar secured at an upper end of same. Rotatable wheels are mounted to the crossing support bar at opposite ends of same and are provided with releasable speed limiting or braking means such as brake pads which are normally held in engagement with the wheels, and are removeable from braking contact to permit descent of the hanger means. Adjustable disc braking arrangements or the like may also be employed in conjunction with the releaseable braking means which may be adjusted to limit the speed of normal descent of a patient when the brake release is actuated. At a lower end of the hanger body, a plurality of elongated elements such as chains, ropes or the like are provided which extend below the body to a level where a patient carrying element is to be supported. Chains are preferred, and latch elements such as snap hooks or the like are provided on same to permit adjustment of the length of same. Hence, the forward elongated elements or elements may be adjusted upwardly with respect to the rear elements to permit the patient carrying element to descend in a proper attitude. A brake release means is also associated with the hanger body wheels having an actuator element extending downwardly to a point where it is accessible to a patient being evacuated or to an attendant who is accompanying a patient during descent. With the brake release means, either the patient or the attendant may actuate same, again to permit descent of the hanger, while release of the actuator means will stop movement to avoid collisions with other patients and the like.

With the evacuation system according to the present invention, as will be described in more detail hereinafter, the individual hanger means are easily removable from the system which facilitates storage of same, and also adds flexibility for movement of the hanger means from floor to floor as might be needed during the evacuation. Furthermore, with a plurality of elongated elements suspended from a hanger body, same may be secured to a wheelchair or other similar patient caring element to evacuate the patient in a sitting position, or may be secured to a liter, stretcher or the like for the same purpose. In this vein, depending upon the construction of the patient carrying element, whether a chair, liter, stretcher or the like, should one hanger means not be adequate for the descent, a pair of hanger means may be utilized to support opposite ends of the carrying element.

DESCRIPTION OF THE PREFERRED EMBODIMENT

Figure 1:
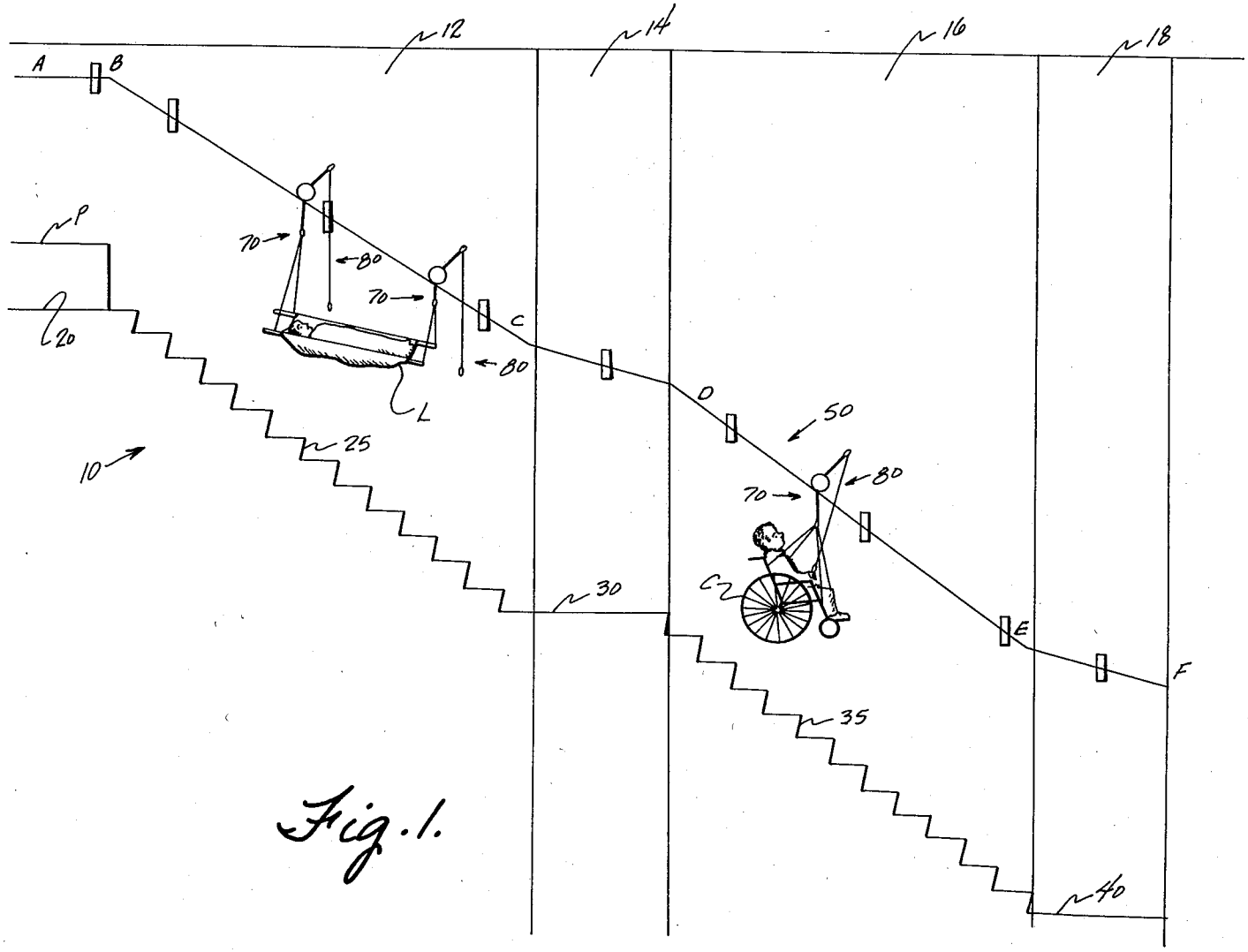
FIG. 1 is a schematic illustration of an open stairwell extending downwardly two levels with one arrangement for a trackway being schematically illustrated therealong, and schematically illustrating two patients being evacuated.

Referring to the figures, preferred embodiments of the present invention will now be described in detail. FIG. 1 schematically illustrates a portion of a multistory structure, generally indicated as 10. Only walls 12, 14, 16 and 18 are shown each of which assists in defining a stairwell therealong. A first landing 20 at level A-B is representative of a top floor of the structure while intermediate landing 30 at level C-D represents a middle floor having a flight of stairs 25 therebetween, and with a lower landing 40 at level E-F symbolizing ground level with a further flight of stairs 35 located between landings 30 and 40. With such an arrangement, a trackway means generally 50 is secured to walls 12, 14, 16 and 18 between points A and E.

As can be seen in FIG. 1, trackway 50 is generally level at point A begins descent at point B down to point C that is generally consistent with the slope of stairs 25 therebetween. A more gradual slope is present for trackway 50 between points C and D across landing 30, after which a sharper slope returns between points D and E along stairs 35, similar to that achieved between points B and C. At landing 40, trackway 50 again assumes a more gradual slope.

As is schematically illustrated in FIG. 1, one patient is being evacuated on a liter L, suspended by two hanger means generally 70, though one such hanger means may be adequate to support a liter. An attendant would walk along with the patient and manipulate both brake release means 80 to control descent of hanger means 70 and thus the patient. In a further embodiment, a hanger means generally 70 is shown on the trackway segment D-E, supporting a patient in a chair C where the patient himself can manipulate brake release means 80 to control his own descent. With either arrangement, it is quite apparent that once a patient is hooked up to a system, say at landing 20, the patient can be conveniently lowered from level A to level F either by himself, or by an attendant, while at the same time controlling the speed of descent to an acceptable rate. A platform P is shown at landing 20 which could be utilized in loading patients onto hanger means 70. As further patients need to be evacuated, they would simply be suspended from one or more hanger means 70 at the landing for the floor where the patient is located, after which the patient may descend along the trailway 50 in a safe and efficient fashion until reaching safety at ground level.

Figure 2:
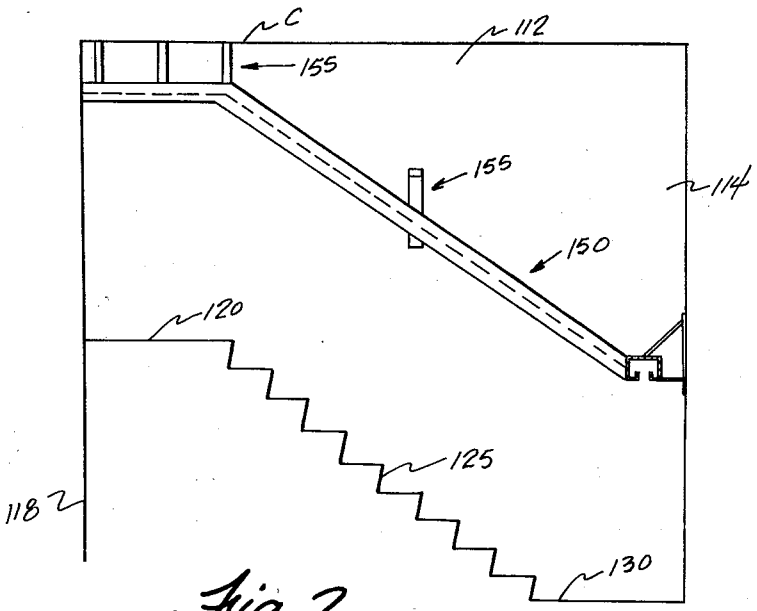
FIG. 2 is a schematic side, cutaway illustration of a closed stairwell as would be typically employed in a multistory structure.
Figure 3:
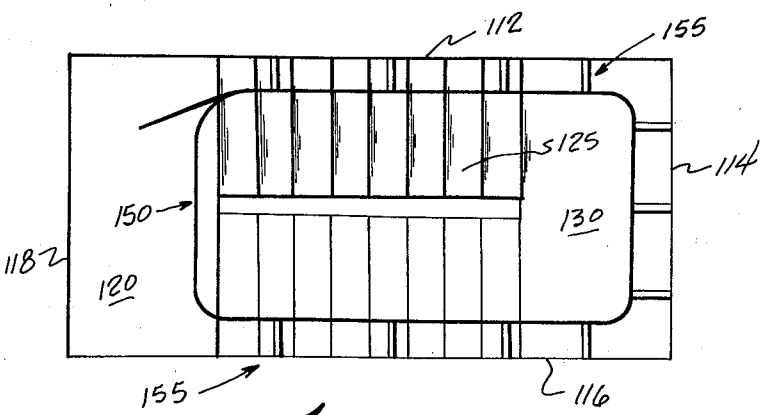
FIG. 3 is a top plan view of a track arrangement as would be present in a stairwell of the type as illustrated in FIGS. 2 and 3.

FIGS. 2 and 3 illustrate a closed type stairwell that is defined by walls 112, 114, 116, and 118 which of course would be located within a multistory structure (not shown). In FIG. 2 a landing 120 is illustrated representative of one story in the building followed by a descending flight of stairs 125 to a second landing 130 which may be a next lower level or may be an intermediate landing between one floor of the structure and another. As illustrated, a trackway means generally 150 is illustrated as secured to the walls defining the stairwell and to the ceiling C by mounting means generally 155 that are spaced along the length of trackway 150. The number of mounting means generally 155 would be determined by the overall weight of the evacuating system as well as the weight of patients to be evacuated thereon. Obviously, such mounting means should be of sufficient strength and rigidity, and so located, that appropriate structural strength is available for the present evacuation system.

Figure 4:
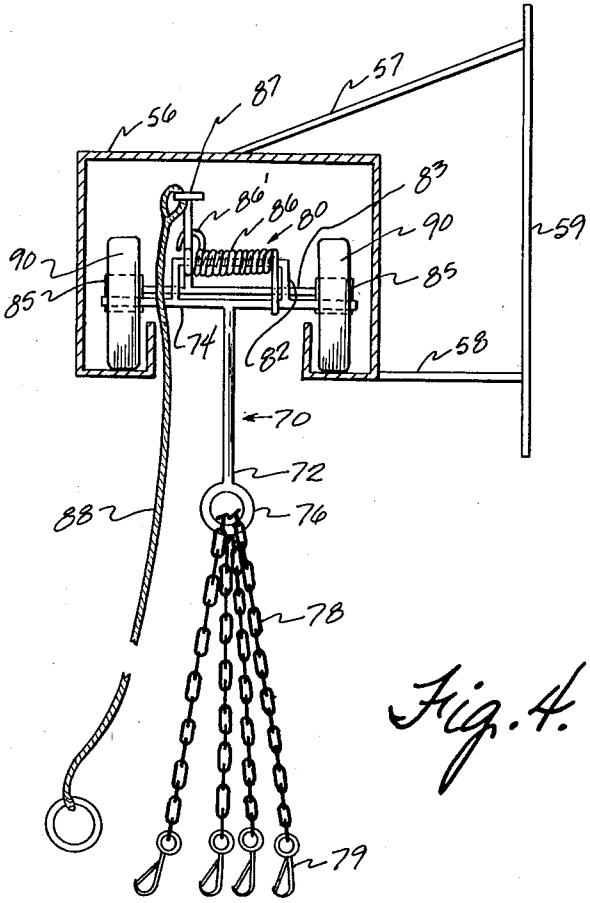
FIG. 4 is an end view of a portion of a patient evacuation system according to the present invention illustrating relationship between the trackway and the hanger means.
Figure 5:
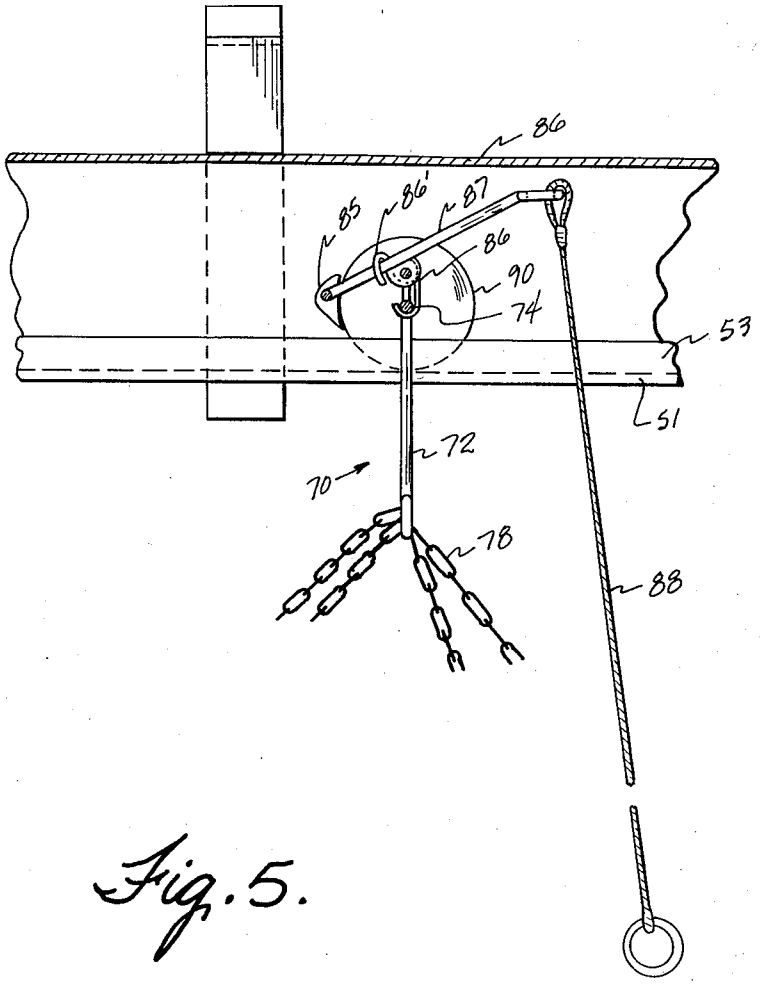
FIG. 5 is a vertical cross sectional view of a portion of the evacuation system as shown in FIG. 4 taken along a line V—V.

FIGS. 4 and 5 are illustrative of a preferred embodiment of the evacuation system according to the present invention. The trackway generally 50 includes a pair of spaced apart rails 51, 52 with upstanding flanges 53, 54 respectively secured thereto along an inside surface of same and extending upwardly therefrom. Flanges 53 and 54 as illustrated in FIG. 4 will preclude lateral movement of a hanger means generally 70 received thereon. Mounting means generally 55 includes a shroud 56 that is secured to rails 51 and 52 and extends upwardly therearound. A pair of support members 57 and 58 are secured to shroud 56 and extend outwardly therefrom to a mounting plate 59 to which an opposite end of support elements 57 and 58 are secured. Mounting plate 59 is then appropriately secured to one of the walls defining the stairwell to properly suspend trackway 50 above the stairs over which it passes. While mounting means generally 55 is illustrated in FIG. 4 for the mounting of tracks 51 and 52 perpendicular to a surface therebelow, obviously as is illustrated in FIGS. 1 and 2 since trackway 50, 150 follow inclination of the stairs along the stairwell, the angular relationship between mounting plate 50 and support elements 57 and 58 may vary considerably. Likewise, for mounting means for securement to the ceiling of the stairwell, obviously, though not shown, the support elements would extend upwardly from shroud 56 to the mounting plate 59.

A preferred hanger means 70 is illlustrated in FIGS. 4 and 5 and includes a hanger body 72 to which a crossing support member 74 is secured at an upper end of same with wheels 90 rotatably secured at opposite ends of same. Each wheel 90 may be provided with a disc brake arrangement 92 (see FIG. 6) that is adjustably positioned with respect to wheel 90 to provide frictional contact therewith and thereby reduce the rotational speed of wheels 90 during descent of the hanger means 70 along trackway 50. Also brake means 80 is associated with wheels 90 to constantly apply braking pressure thereagainst unless released, whereby hanger means 80 will not move down trackway 50 until brake means 80 is released as described hereinafter.

A lower end of body 72 is provided with an eyelet structure 76 through which a plurality of elongated securement means 78 pass and are suspended therefrom. Snap hooks 79 or other attachment means are provided at the terminal ends of elongated securement means 78 to enable same to be attached to a patient carrying element such as a wheelchair, liter, stretcher or the like. As pointed out hereinbefore, descent of the patient down the incline of the stairs is best carried out with the patient maintained in a predetermined attitude. Utilizing the attachment means 79, as shown on securement means 78, the overall length of securement means 78 may then be adjusted as desired. Chains are preferred whereby snap hooks may be moved between links of the chain for length adjustment. In such fashion, the forward elongated securement means 78 may be shortened relative to the rear securement means 78 for example, whereby the wheelchair or liter may descend in a generally level condition or other condition as desired. Since, as mentioned above, inclination of trackway 50, 150 may vary from a top floor to the ground level of a structure, the attitude of the patient becomes particularly important, especially when a stretcher, liter or the like is employed. While suspended in a level condition as illustrated in FIG. 5 where the trackway is parallel to the surface below, once the hanger means 70 starts down an incline path, the liter may not be totally level, though, since the hanger means with the weight of the patient therebelow should seek its own attitude, a generally level condition should continue to exist unless the difference in lengths of the front and rear securement means is too great.

As further illustrated in FIGS. 4 and 5, brake release means generally indicated as 80 is incorporated into hanger means 70. A support arrangement 82 is provided that is secured to crossing member 74 and extends upwardly therefrom with a spring 86 received therearound. A brake release actuating lever 87 passes over support 82 and received a portion 86' of spring 86 therearound. A pair of brake pads 85 are secured to a connector rod 83 at outer ends of same which actuating lever 87 is secured to connector rod 83. Spring means 86 thus continually biases lever 87 in a direction to maintain brake pads 85 in braking contact with wheels 90. Release actuating lever 87 extends angularly outwardly from brake means 80, and a cord 88 is secured to an outer end of same. Cord 88 extends from lever 87 to a level accessible to the patient and/or an attendant for the patient.

With a patient suspended from hanger means 70, either the patient or the attendant by pulling down on brake release cord 88 will release brake pads 85 from frictional, braking contact with the surfaces of wheels 90 to permit rotation of wheels 90 and thus permit the descent of hanger means 70. At any point, should brake release means 80 be deactuated by release of cord 88, hanger means 70 will fully cease downward movement unless the angle of descent is such that the wheels slide along the rails.

Figure 6:
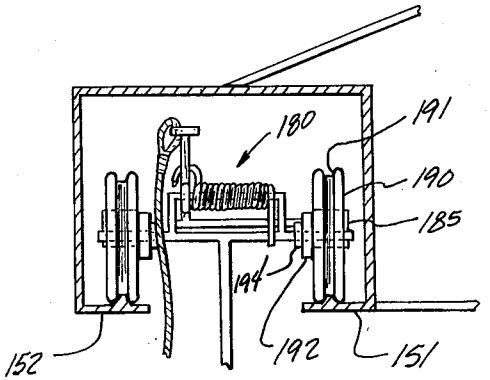
FIG. 6 is a partial end view of a further embodiment of an evacuation system according to the present invention.

FIG. 6 illustrates, in part, a further embodiment of an evacuation system according to the present invention. In general many aspects of same are like that as described with respect to FIGS. 4 and 5 whereby only the areas of difference will be described. Particularly, the spaced apart tracks 151 and 152 have a generally frustoconical cross section while wheels 190 rotatably supported thereon include grooves 191 therein which mate with the outer surface configuration of rails 151 and 152. Lateral movement of hanger means 170 with respect to the trackway 150 is thus precluded. As discussed hereinbefore, with respect to FIG. 4, wheels 190 are provided with brake means 180 which would be structured as described above except that brake pads 185 may make contact with groove 191 of wheels 190. Also, a rotation limiting system is added to wheels 190, represented by disc 192 that is held in pressure engagement with wheels 190 by a pressure adjustment nut 194. Obviously, this speed limiting means should not be considered to be limiting insofar as the present invention is concerned, and any means that would so continuously reduce the speed rotation of the wheels during descent of the hanger means could be suitably employed herewith. Hence once brake release means 180 is actuated to permit descent of hanger means 170, wheels 190 will rotate at a speed determined by the pressure of disc 192 thereagainst. With such an arrangement, the descent rate of hanger means 170 may be reduced considerably from a "free wheeling" speed thus reducing the likelihood of accidents during evacuation as a result of collisions, excessive speed or the like.

Insofar as materials of construction for the evacuation system of the present invention is concerned, obviously any materials may be employed that have adequate structural strength and rigidity to perform the intended function. Lightweight metals or reinforced plastic materials are preferred due to the performance characteristics, of weight and the ease of use of same in fabrication. Also, each hanger means 70, 170 may be lifted above the tracks 51, 52, or 151, 152, rotated 90°, and withdrawn between the rails. Mounting of hangers would be the reverse. Such facilitates storage and flexibility of distribution of the hanger means.

Having described the invention in detail as to preferred embodiments, it is obvious that certain modifications or alterations may be made thereto without departing from the scope of the present invention. The scope of the present invention should thus be determined by the claims appended hereto.

That which is claimed is:

1. A patient evacuation system comprising:

(a) a trackway means mountable in a stairwell at a height that normal use of stairs located in the stairwell will not be impaired thereby, said trackway means including a hanger rail support and mounting means secured thereto, said mounting means being adaptable for securement within said stairwell above said stairs;

(b) hanger means associable with said trackway said hanger means having roller means received thereon for receipt on said hanger rail support, and brake means normally in braking engagement with said roller means;

(c) means associated with said hanger means for removable securement of a patient carrying element thereto; and (d) brake release means associated with said brake means, said brake release means having actuator means accessible to said patient carrying element to be supported by said hanger means; whereby a patient residing in a patient carrying element removably secured to said securement means may be suspended from said hanger means for controlled descent along said trackway.

2. A system as defined in claim 1 wherein said hanger rail support includes two spaced apart rails, said rails having an upstanding flange along a side of same for holding said hanger means thereon.

3. A system as defined in claim 2 wherein said mounting means for said hanger rail support comprises a shroud secured to a portion of said rails, said shroud having structural support members secured thereto and extending outwardly therefrom, and a mounting plate secured to an outer end of said structural support members, said mounting plate being secureable to a wall surface defining said stairwell, and said mounting means being sized to locate said hanger rail support above said stairs.

4. A system as defined in claim 1 wherein said hanger means comprises an elongated support rod, said rod having a crossing support member secured to an upper end of same, said roller means being secured for rotation at opposite ends of said crossing support member, an opposite end of said elongated support rod being adapted for receipt of said patient carrying element securement means.

5. A system as defined in claim 4 wherein said patient carrying element securement means comprise a plurality of elongated elements, said elements having means at an end of same for securement of same to said patient carrying element.

6. A system as defined in claim 5 wherein said elongated elements are adjustable in length, whereby a patient carrying element may be generally leveled for transport down said stairs.

7. A system as defined in claim 6 wherein said elongated elements are lengths of chain, said chains having hook means at outer free ends of same, whereby said chains may be passed about a portion of patient carrying element and hooked to a portion of said chain to achieve a predetermiend chain length thereabove.

8. A system as defined in claim 7 wherein said support rod has a chain receiving element secured at a lower end of same and wherein said chains pass through said chain receiving element and are suspended therefrom.

9. A system as defined in claim 1 wherein said roller means are wheels, said wheels having speed limiting means operatively associated therewith whereby a predetermined amount of resistance to rolling is incorporated into said wheels.

10. A system as defined in claim 9 wherein said speed limiting means are discs contactable with said roller means under predetermined pressure.

11. A system as defined in claim 1 wherein said brake means comprises brake pad means, said pad means being urged against said roller means by spring tension.

12. A system for evacuation of nonambulatory patients from a multistory hospital, nursing home or the like comprising:

(a) a trackway means mountable to a wall defining a stairwell at a height that normal use of stairs located in said stairwell will not be impaired thereby, said trackway means comprising a pair of spaced apart rails, each of said rails having means thereon to limit lateral movement of roller means received thereon, said rails generally following the inclination of the stairs located in said stairwell, and having curved sections for landings between flights of stairs, and mounting means spaced along said rails and being secured thereto, said mounting means being adaptable for securement to a wall defining said stairwell;

(b) hanger means removeably associable with said rails, said hanger means comprising a hanger body, said body having a pair of spaced apart wheels rotatably secured at an upper portion thereof, said wheels being mateable with said rails for rolling movement therealong, said body having means located at an opposite end of same for receiving patient carrying element securement means, said wheels having normally applied brake means associated therewith whereby said hanger means will not normally descend along said rails;

(c) patient carrying element securement means associated with said hanger body, said securement means extending downwardly from said body and being adapted for removeable securement to a patient carrying element to suspend same from said body for movement therewith; and (d) brake release means associated with said brake means; said brake release means having an actuator associated therewith, said actuator extending down from said body to a level where said patient carrying element will be suspended, whereby actuation of said brake release means will permit descent of said hanger means along said trackway, and thus controlled descent of a patient residing in a patient carrying element removeably secured to said securement means.

13. A system as defined in claim 12 wherein said rails having an upturned flange section adjacent an inner surface of same.

14. A system as defined in claim 12 wherein said rails and said wheels are adapted for mating engagement whereby relative lateral movement therebetween is precluded.

15. A system as defined in claim 12 wherein said rail mounting means comprises a mounting plate secureable to a wall of said stairwell, said mounting plate having a lower support member secured thereto and extending outwardly therefrom, and an upper support member secured thereto and extending outwardly therefrom, and a shroud secured to said support members at the outer ends of same, said shroud being secured about said rails.

16. A system as defined in claim 12 wherein said hanger body comprises an elongate rod and a crossing member secured to said rod at an upper end of same, said wheels being rotatably secured at opposite ends of said crossing member, said hanger means being removeable from said trackway by lifting same above said rails and rotating said wheels about 90°, whereby said wheels will pass through the space between said rails.

17. A system as defined in claim 12 wherein said speed limiting means for said wheels comprise a disc that is located against a side of each wheel, said disc being provided with means to apply predetermiend disc pressure against said wheels for limiting the speed of rotation of same.

18. A system as defined in claim 16 wherein said means for receiving patient carrying element securement means comprises an eyelet structure secured to said rod adjacent an end opposite said crossing member, said securement means passing therethrough and being suspended therefrom.

19. A system as defined in claim 12 wherein said patient carrying element securement means comprises a plurality of elongated support elements, said elements having means thereon for attachment to a patient carrying element.

20. A system as defined in claim 19 wherein said securement means are chains and said attachment means are hooks.

21. In a multistory patient treatment facility having a stairwell extending from upper floors to a ground floor with stairs therein and landings located between adjacent flights of stairs, the improvement comprising a patient evacuation system secured within said stairwell for receiving patients in a sitting or reclining disposition thereon whereby the patient may move along said system to the ground floor, said evacuation system comprising:

(a) a trackway means secured to a wall defining said stairwell and being located adequately above said stairs and said landings that normal use of same are not precluded, said trackway means comprising at least one rail following the inclination of the stairs and defining curved sections around said landings, and mounting means secured to said rail and said wall;

(b) hanger means receivable on said at least one rail for gravitational movement therealong, said hanger means being removeably securable to a patient carrying element to suspend said element above said stairs and said landings for transport to the ground floor, said hanger means having brake means operatively associated therewith to brake said hanger means against movement, and brake release means associated with said brake means and accessible to a patient descending along said trackway, or an attendant therefor, whereby descent of a patient in a patient carrying element removeably secured to said hanger means may be controlled.

22. The improvement as defined in claim 21 wherein said trackway comprises two spaced apart rails, said rails being adapted to preclude significant lateral movement of a hanger means received thereon.

23. The improvement as defined in claim 21 wherein a feeder trackway is located at every entrance to said stairwell above the ground floor for admitting patients to enter the system thereat.

24. The improvement as defined in claim 21 wherein the hanger means comprises a body, said body having wheels rotatably received at an upper end of same for receipt on said trackway, said body extending downwardly from said trackway and having elongated elements associated therewith and extending therebelow, said elongated elements being adapted for securement to a patient carrying element to suspend same over said stairs for gravitational descent along said system.

25. The improvement as defined in claim 24 wherein said wheels have means associated therewith to limit the rotation of same for slowing patient descent along said system.

26. The improvement as defined in claim 25 wherein said speed limiting means in a disc engageable with a portion of said wheel and being adjustable with respect thereto.

* * * * *